US008613365B2

(12) United States Patent
O'Quinn et al.

(10) Patent No.: US 8,613,365 B2
(45) Date of Patent: Dec. 24, 2013

(54) SHELVING SYSTEM UPRIGHT ASSEMBLY

(75) Inventors: Taft O'Quinn, Inola, OK (US); Michael Martin, Fayetteville, AR (US); Val-Jean Duchene, Centerton, AR (US)

(73) Assignee: L.A. Darling Company, LLC, Paragould, AR (US)

( * ) Notice: Subject to any disclaimer, the term of this patent is extended or adjusted under 35 U.S.C. 154(b) by 0 days.

(21) Appl. No.: 13/327,594

(22) Filed: Dec. 15, 2011

(65) Prior Publication Data

US 2012/0285917 A1 Nov. 15, 2012

Related U.S. Application Data

(60) Provisional application No. 61/423,389, filed on Dec. 15, 2010.

(51) Int. Cl.
*A47F 5/14* (2006.01)
*A47B 43/00* (2006.01)

(52) U.S. Cl.
USPC ..... 211/182; 211/189

(58) Field of Classification Search
USPC ..... 211/182, 189, 190, 191, 196, 204, 206, 211/26, 105.3–105.6, 123, 187, 188, 194, 211/178; 403/292, 298, 359.1, 361; 248/127, 150, 151, 152, 165, 174
See application file for complete search history.

(56) References Cited

U.S. PATENT DOCUMENTS

| | | | | | |
|---|---|---|---|---|---|
| 1,841,204 | A * | 1/1932 | Overholtz | 40/624 |
| 3,200,775 | A * | 8/1965 | Peters | 108/108 |
| 3,424,178 | A * | 1/1969 | Yazaki | 135/157 |
| 3,465,898 | A * | 9/1969 | Klein | 211/194 |
| 3,642,310 | A * | 2/1972 | Hudson | 403/219 |
| 3,865,250 | A * | 2/1975 | Jay | 211/194 |
| 3,905,483 | A * | 9/1975 | Patrick | 211/190 |
| 4,126,288 | A * | 11/1978 | De Sisto et al. | 248/188.1 |
| 4,756,413 | A * | 7/1988 | Gits | 206/318 |
| 4,934,015 | A * | 6/1990 | Mink | 15/268 |
| 6,164,467 | A * | 12/2000 | DePottey et al. | 211/189 |
| 7,500,655 | B1 * | 3/2009 | Smith et al. | 256/67 |
| 7,779,568 | B2 * | 8/2010 | Gettelfinger et al. | 40/624 |
| 2010/0270525 | A1 * | 10/2010 | Erwin | 256/65.06 |

* cited by examiner

*Primary Examiner* — Jonathan Liu
*Assistant Examiner* — James Twomey
(74) *Attorney, Agent, or Firm* — R. Blake Johnston, Esq.; DLA Piper LLP US

(57) ABSTRACT

An upright assembly for a shelving system includes a tubular upper upright section having a bottom end portion, a rail assembly and a base assembly having a top end portion and a tubular lower upright section. The base assembly is adapted to stand on a surface and the top end portion of the lower upright section of the base assembly is connected to the bottom end portion of the upper upright section. An insert blade assembly connector including a blade and an alignment plate is positioned within the tubular upper and lower upright sections. The rail assembly is connected to the upper upright section and the lower upright section of the base assembly to strengthen the connection between the upper upright section and the base assembly.

9 Claims, 5 Drawing Sheets

SHELVING SYSTEM UPRIGHT ASSEMBLY

CLAIM OF PRIORITY

This application claims priority to provisional patent application No. 61/423,389, filed Dec. 15, 2010, currently pending.

FIELD OF THE INVENTION

The present invention generally relates to retail shelving systems and, more particularly, to an upright for a retail shelving system.

BACKGROUND OF THE INVENTION

Retail shelving systems often include a base to which generally vertical, upright tubing is attached. The tubing typically includes slots or the like for receiving shelf brackets upon which shelves are supported. In the retail shelving industry, it is common for extensions to be inserted in the open top ends of upright tubes to gain additional space to hang shelves.

Prior art extensions typically employ connectors that are "X" shaped and fabricated from flat steel components. These are light duty designs, however, and thus are not capable of carrying heavy shelf loads and generally are not used to connect entire uprights to their base legs.

Other connectors for joining tubing have been developed. These include the connectors described in U.S. Pat. No. 5,904,437 to Allen; U.S. Pat. No. 6,062,761 to Allen; U.S. Pat. No. 5,464,299 to Scharer et al.; U.S. Pat. No. 6,874,971 to Albaugh and U.S. Pat. No. 4,161,375 to Murphy. While these designs may be effective, they employ threaded fasteners and/or are difficult to manufacture which increases cost and complexity of use.

Furthermore, most existing upright tubing designs are large, welded assemblies that are bulky and cumbersome to handle. This presents challenges both in manufacturing and shipping. The parts occupy a large amount of space on the paint line and require non-standard pallets for shipping. By splitting the upright tubing into two sub assemblies or sections, standard size pallets can be used and the parts will hang more densely on the paint line thus reducing manufacturing and shipping costs.

Most previous attempts to create a two-piece upright have employed connections designed to fit snugly within the upright tube. The problem with this approach is that the internal dimensions of the tubing can vary greatly due to normal manufacturing tolerances. As a result, it is extremely difficult to create a joint that is consistently tight to prevent deflection of the uprights when the shelves are assembled and loaded.

DETAILED DESCRIPTION OF EMBODIMENTS

Figure 1:
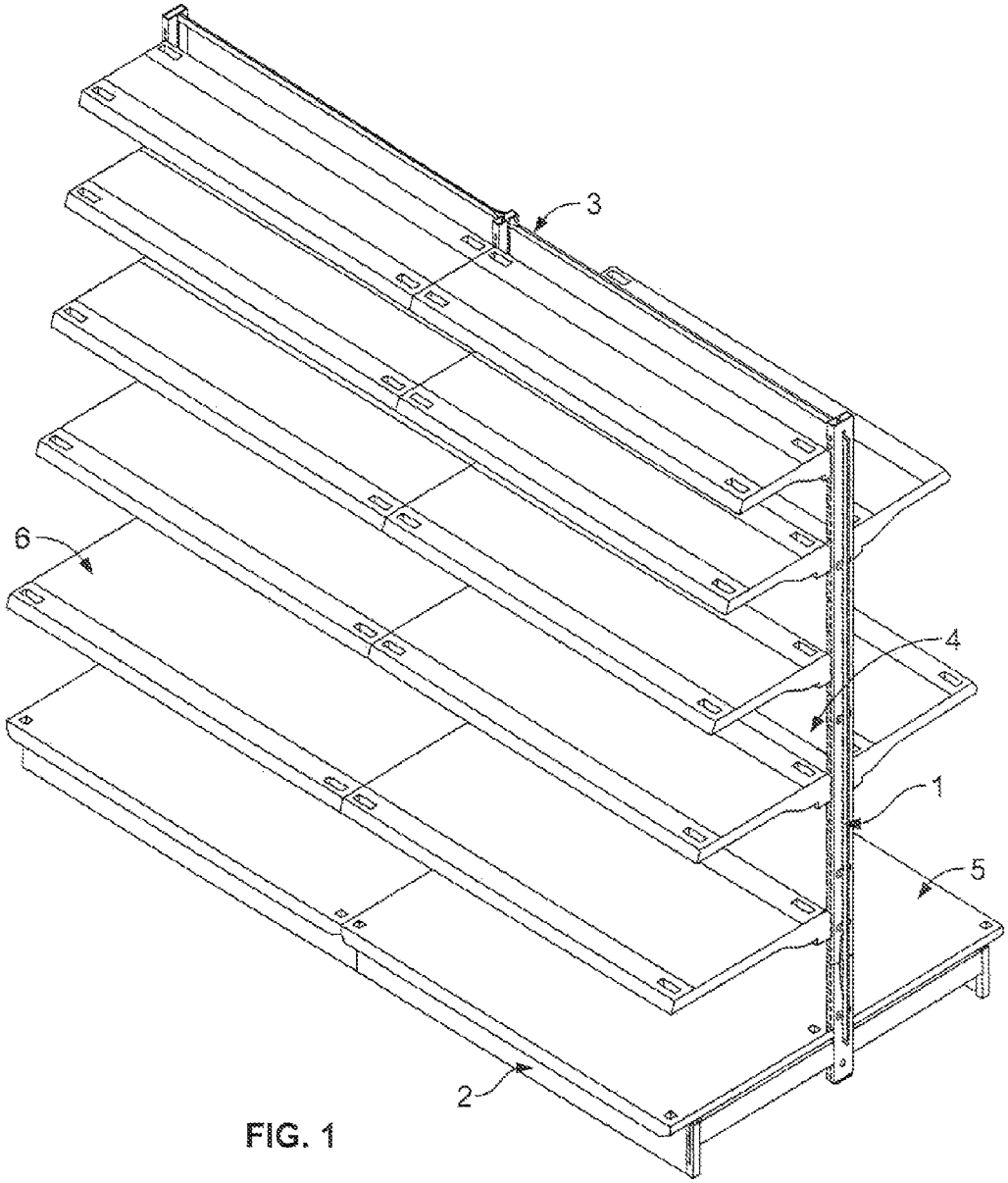
FIG. 1 shows a top side perspective view of a retail shelving system gondola including an embodiment of the shelving system upright assembly of the present invention.

An assembled portion of a common gondola run of a retail shelving system can be seen in FIG. 1. The run consists of Upright Assemblies (1) connected together by Kickplates (2) and Top Panel Retainers (3). Back Panels (4) are assembled between the Upright Assemblies to provide lateral stability and separate the sides of the Gondola. Base Decks (5) and Shelf Assemblies (6) are installed on the assembled uprights to hold retail merchandise.

Figure 2:
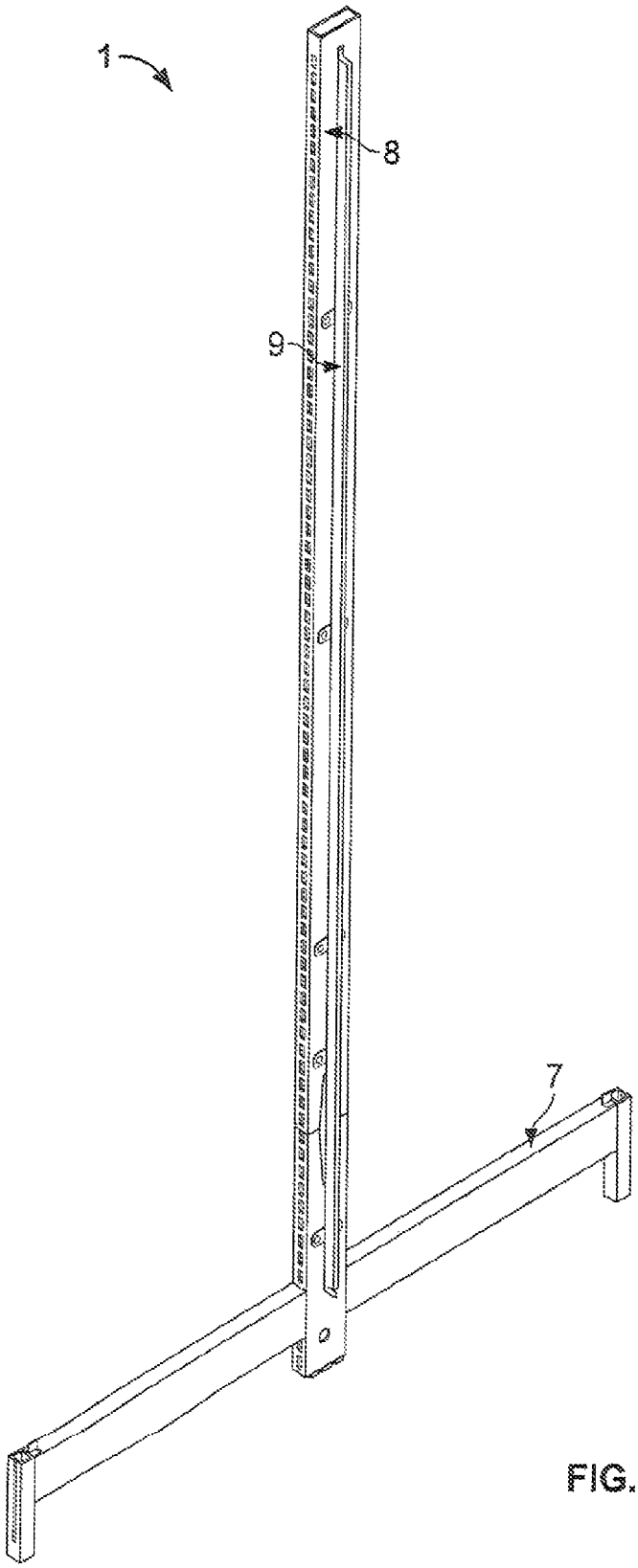
FIG. 2 is an enlarged top side perspective view of the embodiment of the shelving system upright of the present invention of FIG. 1.
Figure 3:
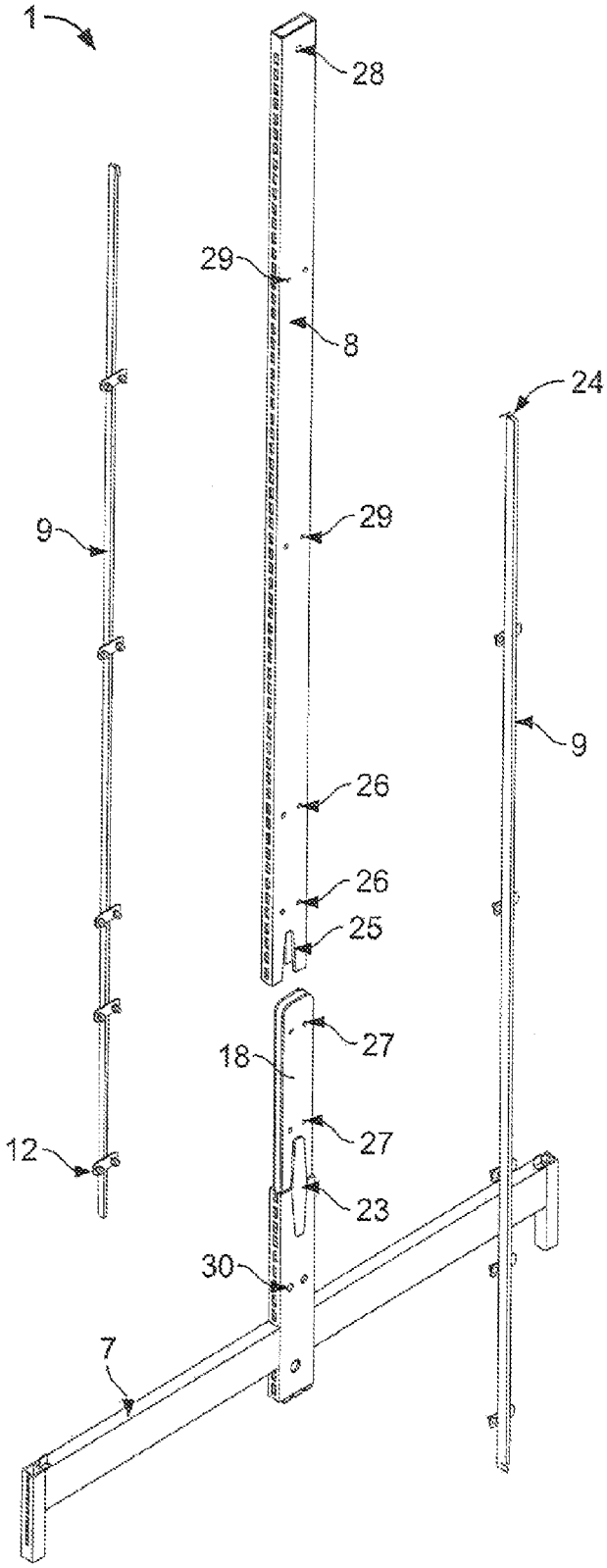
FIG. 3 is an exploded view of the upright assembly of FIG. 2.

One Upright Assembly is shown in greater and exploded detail in FIGS. 2 and 3. The assembly is composed of an Upright Base Assembly (7) and a Upper Upright Section (8). These two pieces are mechanically connected through features included in the Back Panel Rail Assembly (9) and Insert Blade Assemblies described below with respect to FIGS. 3 and 5.

Figure 4:
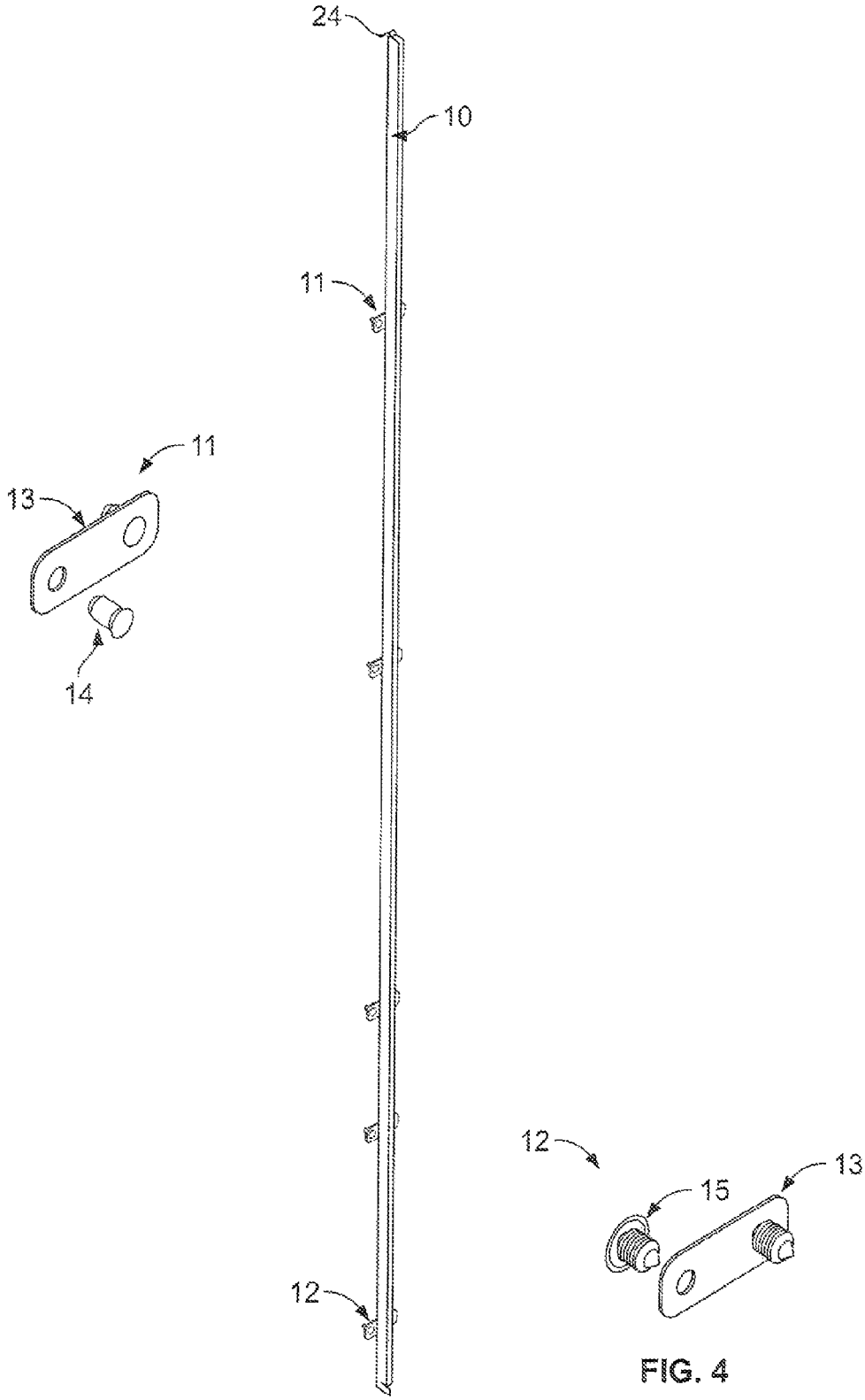
FIG. 4 is an enlarged top side perspective view of the back panel rail assembly and enlarged and partially exploded views of the pin bracket assemblies and a retainer bracket assembly of the upright assembly of FIGS. 2 and 3.

The details of the Back Panel Rail Assembly are illustrated in FIG. 4. The assembly consists of a Back Panel Rail (10), four Pin Bracket Assemblies (11), and a Retainer Bracket Assembly (12). These bracket assemblies are mechanically attached to the Back Panel Rail via spot welds or other means. The Pin Bracket Assembly (11) is composed of a Plate (13) and two Self Clinching Studs (14), which may be, as an example only, PEM P/N TPS-250-8. The Retainer Bracket (12) is composed of the same Plate (13) as the pin Bracket (11) and a Tree Fastener (15), which may be, as an example only, ITW Fastex P/N 2601-00-0101.

Figure 5:
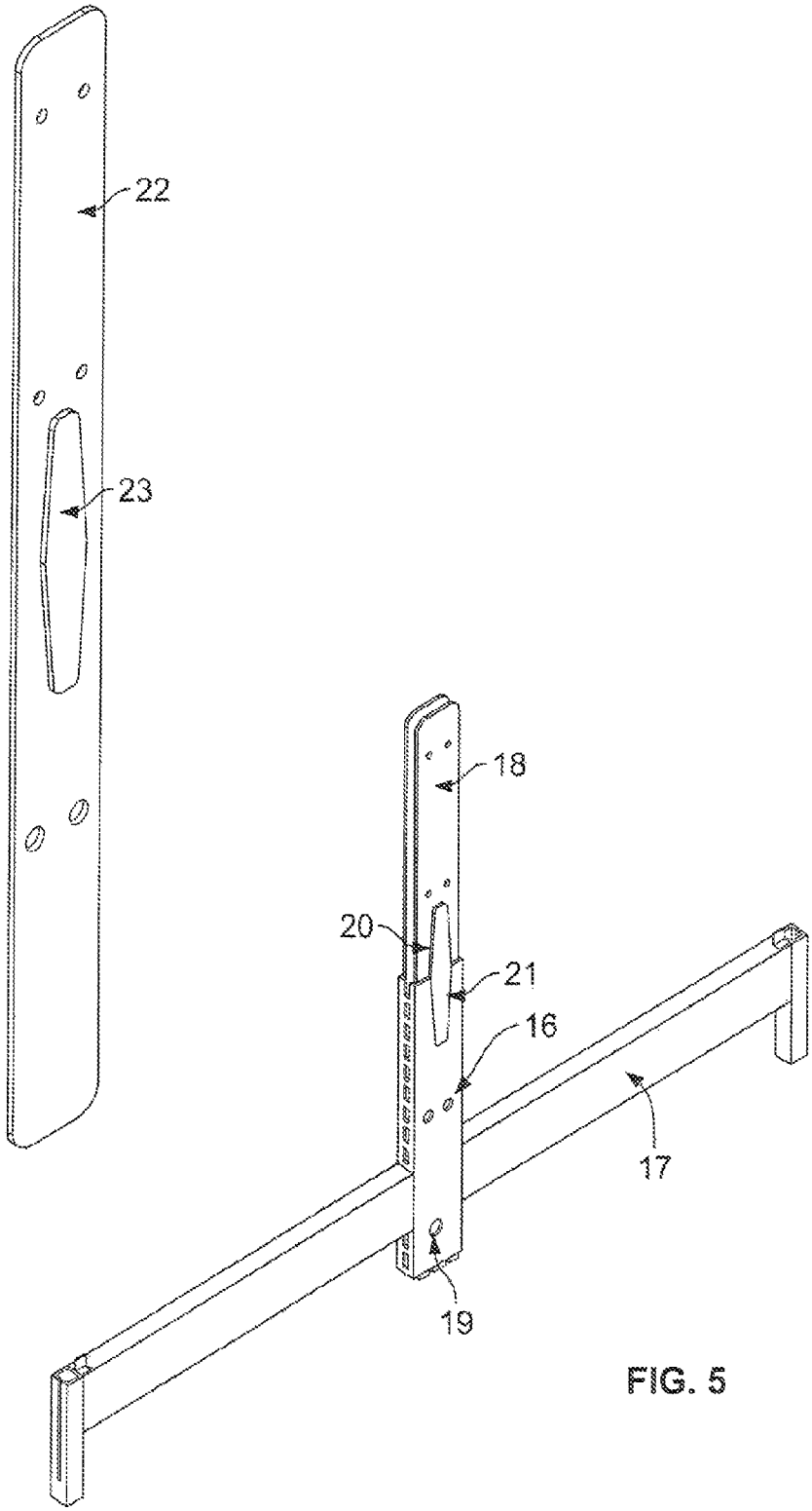
FIG. 5 includes enlarged top perspective views of the upright base assembly and an insert blade assembly of the upright assembly of FIGS. 2 and 3.

As illustrated in FIG. 5, the Upright Base Assembly consists of a Lower Upright Section (16), two base legs (17) and two Insert Blade Assemblies (18). The Insert Blade Assemblies are composed of an Insert Blade (22) and an Alignment Plate (23), these two components are mechanically connected using spot welds or similar means. The Insert Blade Assemblies are attached to the Lower Upright Section with welds at locations 19, 20 and 21.

With reference to FIG. 3, to assemble the Upright Assembly, the Upper Upright Section (8) is slid over the Insert Blade Assemblies (18) on each side of the Upright Assembly. The "v" notch (25) of the Upper Upright Section engages the Alignment Plate (23) which serves to align the two upright sections. Once installed the pairs of holes (26) in the Upper Upright Section (8) align with corresponding pairs of holes (27) in the Insert Blade Assemblies (18). The Back Panel Rail Assemblies (9) are installed on each side of the Upright Assembly to tie the sections together by inserting a tab (24) into the hole (28) in the Upper Upright Section and rotated into the assembled position. The upper two Pin Bracket Assemblies on the Back Panel Rail Assembly engage elongated slots (29) and the lower two Pin Bracket Assemblies engage the holes (26 and 27) in the Upper Upright Section and the Insert Blade Assemblies. Finally the Tree Fasteners of the Retainer Bracket (12) are pressed into the holes (30).

The embodiment of the invention disclosed above resulted from a consideration of manufacturing operations that readily hold close tolerances and can be used to create a joint that provides a consistent fit between parts. In the disclosed embodiment, holes and pins are used to transfer loads between the upright halves, and wedge features are used to provide both alignment and additional strength.

Additionally, the disclosed embodiment provides eased assembly compared to prior art systems and provides opportunities to modify the upright height by simply changing the top half of the upright.

While the preferred embodiments of the invention have been shown and described, it will be apparent to those skilled in the art that changes and modifications may be made therein without departing from the spirit of the invention, the scope of which is defined by the appended claims.

What is claimed is:

1. An upright assembly for a shelving system comprising:

a. a tubular upper upright section having a bottom end portion;

b. a rail assembly; and c. a base assembly including a tubular lower upright section, a top end portion, and a connector that connects the top end portion of the base assembly to the bottom end portion of the upper upright section, said base assembly adapted to stand on a surface;

wherein the connector includes at least one blade assembly that comprises an insert blade and an alignment plate connected to the insert blade and the at least one blade assembly engages interiors of the tubular upper and lower upright sections wherein the rail assembly includes a back panel rail and a plurality of pin bracket assemblies, each pin bracket assembly including a pin bracket plate attached to the back panel rail and having a pin bracket plate opening and a pin bracket fastener passing through the pin bracket plate opening and engaging corresponding openings in the upper upright section;

wherein the base assembly includes a lower upright section and the rail assembly further comprises a retainer bracket assembly including a retainer bracket plate attached to the back panel rail and having a retainer bracket plate opening and a retainer bracket fastener passing through the retainer bracket plate opening and engaging a corresponding opening in the lower upright section of the base assembly.

2. The upright assembly of claim 1 wherein the rail assembly is connected to the upper upright section and the base assembly to strengthen the connection between the upper upright section and the base assembly.

3. The upright assembly of claim 1 wherein the connector includes two blade assemblies.

4. The upright assembly of claim 1 wherein each insert blade is welded to the lower upright section.

5. The upright assembly of claim 1 wherein the upper upright section and the lower upright section each feature a notch and the alignment plate of the at least one blade assembly engages the notches of the upper upright section and the lower upright section.

6. The upright assembly of claim 5 where in the alignment plate is welded to the insert blade of the at least one blade assembly.

7. The upright assembly of claim 1 wherein the fasteners are studs.

8. The upright assembly of claim 1 wherein the retainer bracket fastener is a tree fastener.

9. The upright assembly of claim 1 wherein the base assembly includes a lower upright section and a base leg attached to the lower upright section.

* * * * *